US005996886A

United States Patent [19]

Evert

[11] Patent Number: 5,996,886

[45] Date of Patent: Dec. 7, 1999

[54] EASY OPEN FEATURE FOR CONTAINERS

[75] Inventor: Daniel D. Evert, Vernon Hills, Ill.

[73] Assignee: Kraft Foods, Inc., Northfield, Ill.

[21] Appl. No.: 08/954,958

[22] Filed: Oct. 21, 1997

[51] Int. Cl.[6] ..... B65D 17/00

[52] U.S. Cl. ..... 229/243; 229/207; 229/925; 229/215

[58] Field of Search ..... 229/243, 925, 229/215, 207

[56] References Cited

U.S. PATENT DOCUMENTS

| | | | |
|---|---|---|---|
| 2,626,096 | 1/1953 | Hickin | 229/207 X |
| 2,679,349 | 5/1954 | Mullinix | 229/925 X |
| 2,936,937 | 5/1960 | Guyer | 229/207 X |
| 2,953,293 | 9/1960 | Anderson | 229/925 X |
| 3,186,623 | 6/1965 | Guyer | 229/925 X |
| 3,521,809 | 7/1970 | Zimmerman . | |
| 3,735,914 | 5/1973 | Collura et al. . | |
| 3,905,646 | 9/1975 | Brackmann et al. | 229/207 X |
| 3,982,685 | 9/1976 | Shimada . | |
| 4,158,412 | 6/1979 | Wysocki | 229/207 |
| 4,317,518 | 3/1982 | Mode . | |
| 4,449,633 | 5/1984 | Johnson et al. | 229/207 X |
| 4,712,737 | 12/1987 | Hecking . | |
| 5,035,330 | 7/1991 | Kuchenbecker . | |
| 5,518,174 | 5/1996 | Botterman . | |
| 5,531,376 | 7/1996 | Brink et al. . | |
| 5,573,177 | 11/1996 | Hough | 229/215 X |
| 5,660,323 | 8/1997 | Spronk | 229/215 |

FOREIGN PATENT DOCUMENTS

| | | | |
|---|---|---|---|
| 0606816 | 10/1960 | Canada | 229/207 |

*Primary Examiner*—Jes F. Pascua
*Assistant Examiner*—Tri M Mai
*Attorney, Agent, or Firm*—Fitch, Even, Tabin & Flannery

[57] ABSTRACT

The invention comprises a container, preferably of paperboard or other packaging materials, with an easy open feature including an opening tab in a wall or panel of the container for providing a dispensing aperture in the container. The opening tab is formed by a first cut line located in the inner surface of a wall or panel of the container and a second cut line located in the outer surface of the wall or panel container, offset a predetermined distance from the first cut line. The first and second cut lines create a frangible area in the wall or panel, which allows the opening tab to separate from the container wall. The frangible area further is provided with restraining portions to control and resist the inadvertent or unexpected separation of all or part of the tab from the container wall.

14 Claims, 4 Drawing Sheets

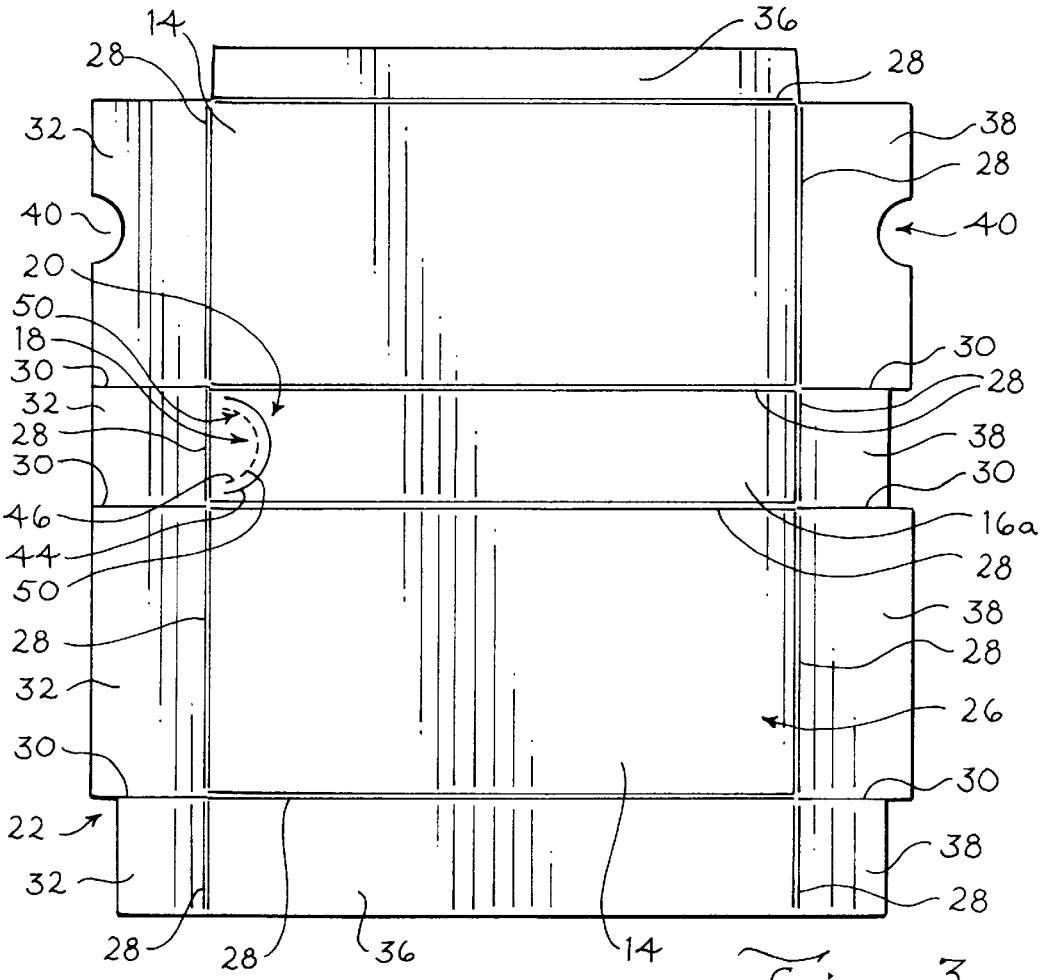
Fig. 3
Fig. 8 (PRIOR ART)
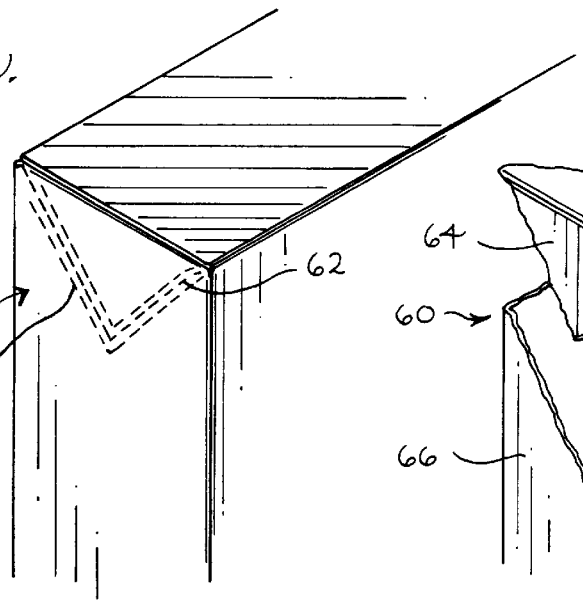
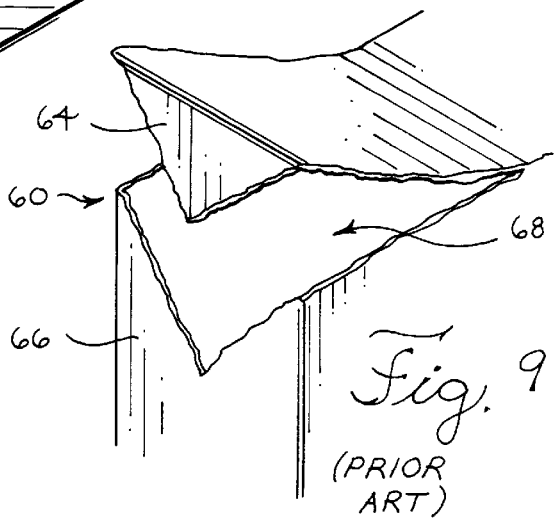
Fig. 9 (PRIOR ART)

EASY OPEN FEATURE FOR CONTAINERS

This invention is generally directed to the opening features used to provide a dispensing aperture for paperboard and other similar containers, including paperboard boxes used for shipping, displaying and dispensing food products. The invention is more specifically directed to easy opening features that maintain the integrity, appearance and safety of such containers.

BACKGROUND OF THE INVENTION

The marketing, distribution and sale of consumer products and other similar products often requires considerable attention to the design of the containers used to package such products. It generally is desirable to provide such containers with a feature that permits the purchaser to open the container with a minimal amount of physical effort. For many containers, such "easy open" features are intended to be operable by pressing a thumb or finger against a portion of the container designated as the opening location, such as a hinged tab that is depressed into the interior of the container. It often is desirable to provide such containers with opening features that also form a dispensing aperture, particularly in containers used for dry and pourable products of various sizes.

Many such opening features are found in existing container designs for paperboard cartons. Such containers typically are made from a precut, unitary blank having various score and die cut lines that permit the automated folding, forming, filling and sealing of the containers. The opening features in such containers often include an opening tab formed by a series of partial perforations or cut lines in the surface of a container wall in the shape of a "V", a "U", an oval, a rectangle or similar shapes. The container is opened by depressing the tab into the interior of the container so that the container wall ruptures or tears at the tab borders along such partial perforations to form an aperture for dispensing the contents of the container.

Such opening tabs may be located at various parts of the containers, and typically are found at the upper portions of a side panel or on the top panel of the container. In paperboard and similar containers, such opening tabs frequently remain connected to the container wall along a hinged side so that the tab is not intermixed with the contents of the container. Containers using such tabs may include complicated pour spouts, various reclosing features and multi-part dispensing controls that operate or become accessible once the tab is depressed and the dispensing aperture is formed.

In other containers, the opening tab and the dispensing aperture act as a finger grip that allow the user to create a larger opening in the container. In such designs, the opening tab is depressed into the interior of the container and the user further inserts a finger or thumb into the resulting aperture. The user continues to pull on the tab, typically towards the top of the container, to peel back the top panel of the container and to create a much larger dispensing aperture. In some designs, the container top panel may be removed entirely, and in others the top panel is designed to fold back on itself or on a hinged portion of the top panel.

The use of an opening tab to provide an aperture and grip to further open the container may be employed in containers for bulky, pourable products such as pastas, cereals and similar food stuffs. This feature also is used for dry foods and other products made of fine particles that are difficult to pour or that have a tendency to cake or clump together, such as flours, bakery mixes, dry soaps, etc. Such opening systems, in addition, may be used for dry products that are used in bulk quantities or are easily damaged and therefore require a large dispensing aperture.

The design of easy open features requires consideration of a number of objectives and performance requirements. For many containers, including paperboard containers, an easy open design must be integrated into the overall container structure with the minimum of complicated or added components. For example, the easy open features in paperboard containers frequently must be integral to a unitary blank used to form the container. It is desirable to avoid the need for additional tabs, flaps, folds, glues, inserts, reinforcements or the like to form the easy open feature to reduce the cost of the container and the steps needed to form the container.

In food containers, easy opening features further require due care to maintain a barrier between the food within the container and the outside environment. Such barriers frequently are necessary to preserve the contents of the container in a safe, sanitary condition and to prevent spoilage of the contents. The barriers must prevent infestation of container contents by insects or microorganisms from the outside environment. In some applications, the barriers must prevent the loss or gain of moisture by the container contents and prevent oxidation or other atmospheric reactions with container contents. It also frequently is desirable to provide such barriers without the use of additional inner liners or overwraps. The same concerns typically apply to non-food products that may be adversely affected by exposure to the environmental conditions outside of the container.

The easy open features in such containers must not compromise the structural integrity and strength of the container. Paperboard containers often are subjected to a variety of impact loads and stress during shipping and handling of the containers in commercial channels of commerce (i.e., trucking, warehousing and shelf stocking) as well as the use or misuse of the container by the end consumers. These stresses and loads include columnar and crush loading during the packing of individual containers in shipping cases and in palletizing the cases for storage at warehouse facilities, as well as vibrational stress during shipment and movement of pallets of the containers. Additional loads may be imposed in warehouse storage when multiple pallets of product are stacked and restacked on top of one another to efficiently utilize warehouse space. In addition, during shipping and storage, the cartons are frequently subject to crush loads, tensile loads and potential penetration by random objects.

Once the containers reach a retailer, they may be subjected to additional stresses and loads during the shelving and display of the product due to, for example, dropped containers, insufficient storage space and misuse of the containers. The end consumers purchasing such containers may subject the containers to additional unexpected stresses. For example, individual containers may be exposed to drops from a variety of heights, crushing weights, shaking, tossing and piercing events that may result in breaches of the container's structural integrity.

Such loss of structural integrity can be evident from obvious deformation of the container, leaks, tears, punctures, and product spoilage. More subtle defects in the container due to shipping and handling stresses include delamination of a container surface and separation of the seals in the container, including those in an easy open feature of the container. These types of failures may be reported directly to the product manufacturer or packager, or they may go unnoticed in unsalable containers returned to a manufacturer without explanation. Accordingly, it is desirable for easy opening container designs to provide features capable of withstanding all of the above stresses and loads without causing container failures or defects, particularly those leading to spoilage or permitting infestation of the container contents. This capability is particularly desirable in paperboard or similar containers which do not employ an inner liner or overwrap such that product leakage and/or contamination may occur readily as a result of loss of integrity of a single wall or opening tab.

One attempt to provide a suitable easy opening feature for paperboard containers was to partially perforate the side panel of a carton from the exterior to a depth less than the thickness of the paperboard. The partial perforations were arranged in one or more rows in "V", "U", or rectangle shapes. The perforations left sufficient paperboard in the perforated area to prevent infestation and to preserve the side panel strength.

To open such containers, the user pressed on the tab area formed by the perforations and pushed the tab into the container. However, these tabs frequently required considerable opening force because the perforations did not fully penetrate the panel and were not of sufficient size to permit easy opening of the container due to concerns about compromising the strength of the container and its resistance to stresses and loads during shipping and handling procedures. The force required to open prior tabs in many instances caused the carton panels to deform, bend or even collapse, and could render the tab itself inoperable.

These types of problems lead to consumer frustration and complaints, as well as the possible loss of sales and increased costs for returned goods. In most instances, the number and depth of the prior perforations could not be practically increased to render the cartons easier to open without weakening the tab area to the point where inadvertent opening, the loss of structural integrity, possible infestation and spoilage became a serious concern.

One alternative approach for an easy open feature used spaced, opposing, "reverse" cuts in the side panel of a paperboard container to form an opening tab. For example, in Zimmerman, U.S. Pat. No. 3,521,809, paperboard cartons are provided with a tab formed from correlated edge cuts spaced from marginal cuts, each of which extended partially through the paperboard from opposite sides of the board stock. The correlated cuts extended from the container side panel into the top panel of the container. The correlated cuts defined a plane of cleavage between the inner extremities of the two cuts about which the paperboard could be fractured by manual pressure.

This design, however, lacked protections from unintentional opening or leaks in the tab due to packing, shipping, storage and use stresses and loads. The advantages of any reduction in opening pressures required to operate the tab in such designs could be offset in many instances by the possibility of the opening tab's premature failure and breach of the container wall. Such designs also encouraged the partial failure of the tab through paperboard delamination and similar failures that disfigured the container and discouraged the sale of the contents of the container.

In Collura et al., U.S. Pat. No. 3,735,914, a removable portion of a container side panel was formed by a pair of generally parallel cut lines which extended only partially through the carton side wall from the outside and inside faces of the paperboard. These lines formed a line of weakness in the paperboard, and additional paperboard flaps ("Van Buren ears") were folded over the panel to reinforce the upper part of the removable portion. The additional reinforcement addressed one problem with earlier "reverse cut" opening features, but increased the cost of the packaging, and complicated forming and filling the container.

The invention provides an opening system that provides the easy opening features desired by manufacturers, packagers and consumers without the disadvantages of the prior opening systems. The invention is further described below.

SUMMARY OF THE INVENTION

The invention comprises a container, preferably of paperboard or other packaging materials, with an easy open feature including an opening tab in a wall or panel of the container for providing a dispensing aperture in the container. The opening tab is formed by a first cut line located in the inner surface of a wall or panel of the container and a second cut line located in the outer surface of the wall or panel container, offset a predetermined distance from the first cut line. The first and second cut lines create a frangible area in the wall or panel, which allows the opening tab to separate from the container wall. The frangible area further is provided with restraining portions to control and resist the inadvertent or unexpected separation of all or part of the tab from the container wall.

In one preferred embodiment, the container is formed from a unitary, die cut blank that is folded or otherwise shaped to form a top panel, a bottom panel and one or more side panels connecting the top and bottom panels. In certain preferred embodiments, the container is a rectangular, square, round, or polygonal shaped box. The outer surface of the container may be printed or decorated to describe the container contents, and the outer surface may be supplied with a variety of surface treatments such as lacquers, laminations, paints or the like.

When pressure is applied to the opening tab by a finger or a thumb, the peripheral portion of the opening tab separates from the side panel, at the frangible area formed by the cut lines, to free the opening tab from the side panel. The separation of the tab from the side panel forms a dispensing aperture. The user also may insert a finger or thumb into the dispensing aperture and continue pulling on the tab and top panels, to tear open the top panel and enlarge the dispensing aperture. The top panel also may be completely removed from the container.

The restraining portions that reinforce the frangible area are of sufficient size and strength to inhibit the separation of the opening tab from the side panel during transport and storage of the container. The restraining portions preferably are formed by segments of the container side panel that span and extend a predetermined distance along at least one of the cut lines. These segments in one preferred embodiment are formed by providing gaps or uncut areas in the second, outer cut line. This preferred construction provides the additional advantage of eliminating the need to provide additional reinforcing flaps, segments or other elements from the container blank or to add other reinforcing materials to the container.

The dimensions and number of the restraining portions will depend on the size of the opening tab and frangible area, the length of the first and second cut lines, the type of materials used to form the container, and the expected use of the container. By the proper selection of the number and dimensions of the restraining portions, the amount of pressure required to free the opening tab from the surrounding paperboard may be predetermined, controlled and adjusted in view of at least the above considerations.

The invention's use of restraining portions preferably formed integrally with the opening tab provides an easy open system that is durable and cost effective. The invention further permits the container manufacturer to predetermine and later adjust the pressure and loading stresses required to separate the opening tab from the surrounding paperboard, in whole or in part, by modifying the number, dimensions and construction of the reinforcing portions with minimal design changes in the container and the equipment used to form the container. The additional flexibility of the invention's opening system allows for a greater variety of applications for the invention's opening system, increased ability to respond to cost, design and marketing considerations typically encountered in the commercial production of such containers, and a wider choice of packaging materials used for such containers.

BRIEF DESCRIPTION OF THE DRAWINGS

FIG. 3 is a bottom plan view of the blank of FIG. 2, showing the inner surfaces of the container.

FIG. 8 is a top perspective view of a prior art opening tab in an unopened condition in a prior art container.

FIG. 9 is a top perspective view of the prior art opening tab shown in FIG. 8 in an opened position.

It should be understood that the drawings are not necessarily to scale. In certain instances, details of the actual structures which are not necessary for the understanding of the present invention have been omitted. It should also be understood that the invention is not limited to the particular embodiments discussed herein.

DETAILED DESCRIPTION OF A PREFERRED EMBODIMENT OF THE INVENTION

The container of the invention may be used for a wide variety of products and in a wide range of applications where easy open features are used. As mentioned above, the invention is well suited for pourable products, particularly bulky products or products that easily cake or bunch together. It also is useful for containers that preferably are opened completely by removal of a top or side panel, or a portion thereof. A preferred embodiment of the invention is shown in FIGS. 1–7 which illustrate a container 10 intended for food products and a blank for forming the container.

Figure 1:
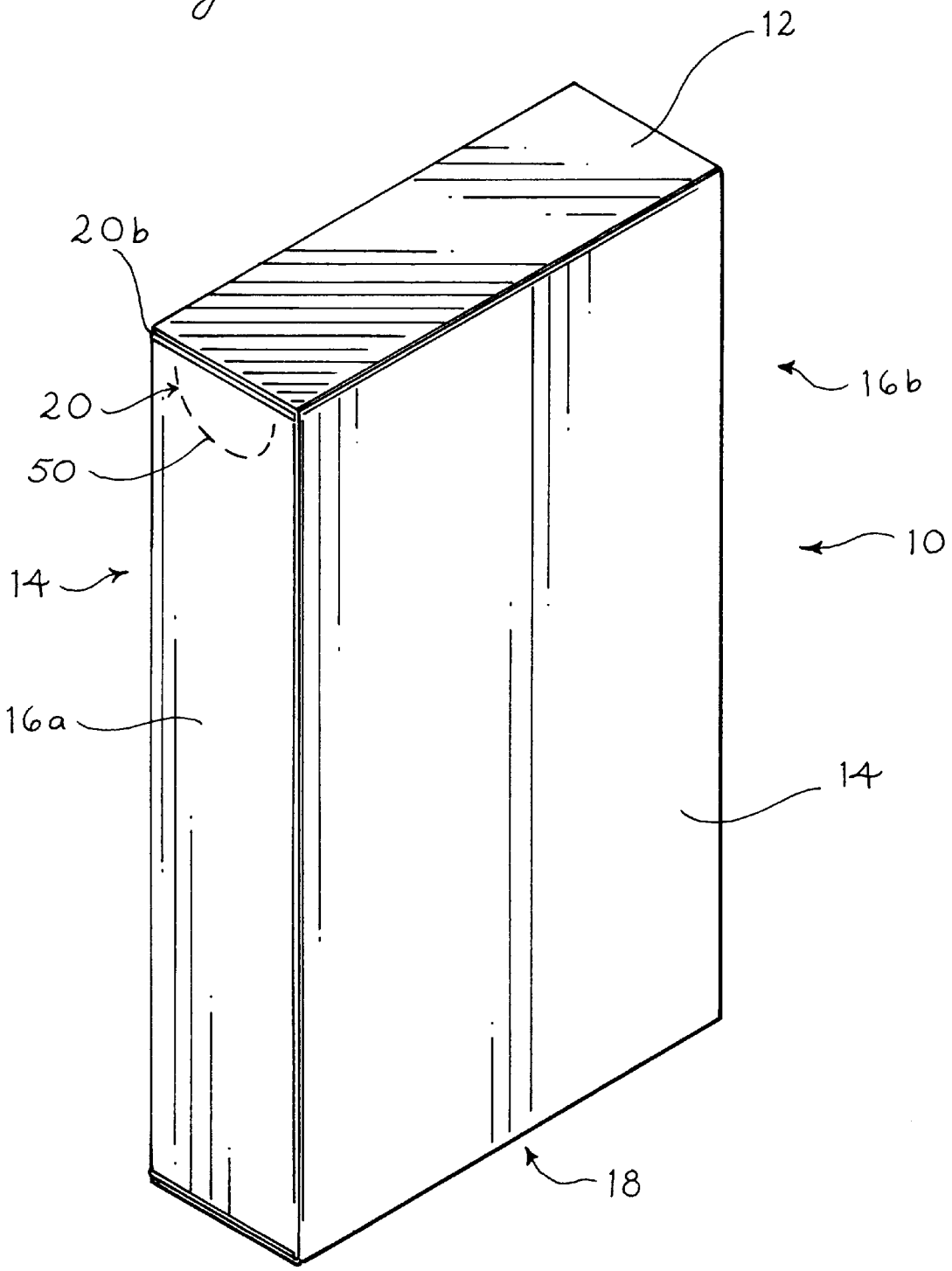
FIG. 1 is a top perspective view of a preferred embodiment of the container of the invention.
Figure 4:
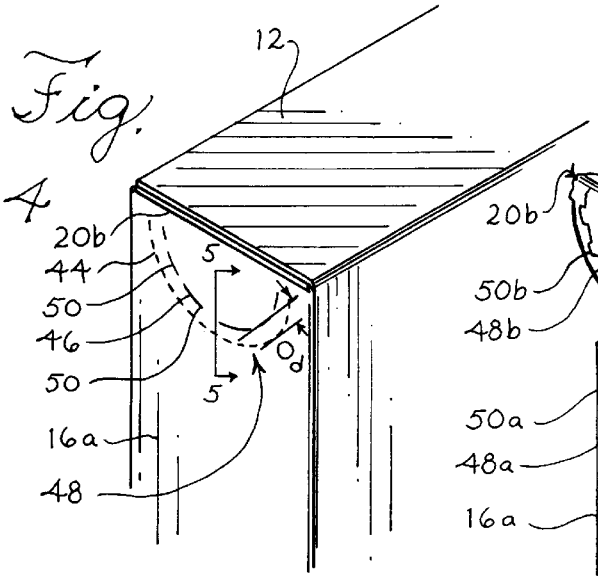
FIG. 4 is a top perspective view of the opening tab of the container of FIG. 1 in an unopened condition.
Figure 6:
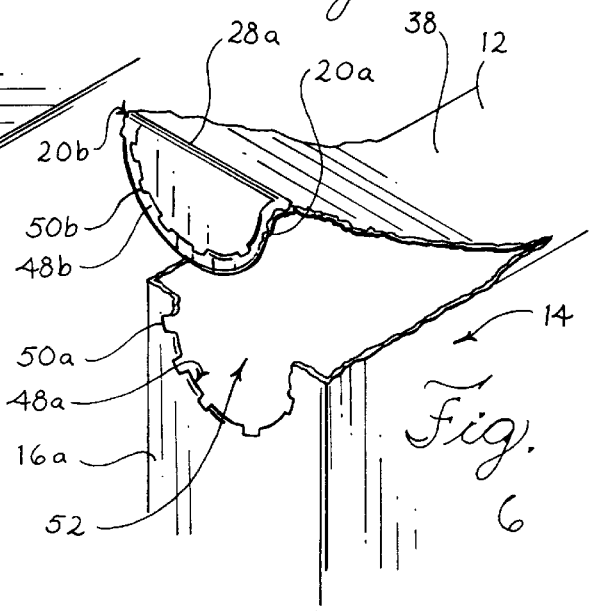
FIG. 6 is a top perspective view of the opening tab of the container of FIG. 1 in an opened position.

In this preferred embodiment, the container 10 of the invention includes a top panel 12, large side panels 14, small side panels 16*a* and 16*b*, and a bottom panel 18, as shown in FIGS. 1, 4 and 6. The container 10 further includes an easy open tab 20 located on one end panel 16*a*, adjacent the top panel 12. The easy open tab 20 may be placed in other locations on the container 10, including in the middle of a panel, depending on the expected use of the container, marketing and artistic design considerations, and the needs of commercial production of large numbers of the container of the invention.

Figure 2:
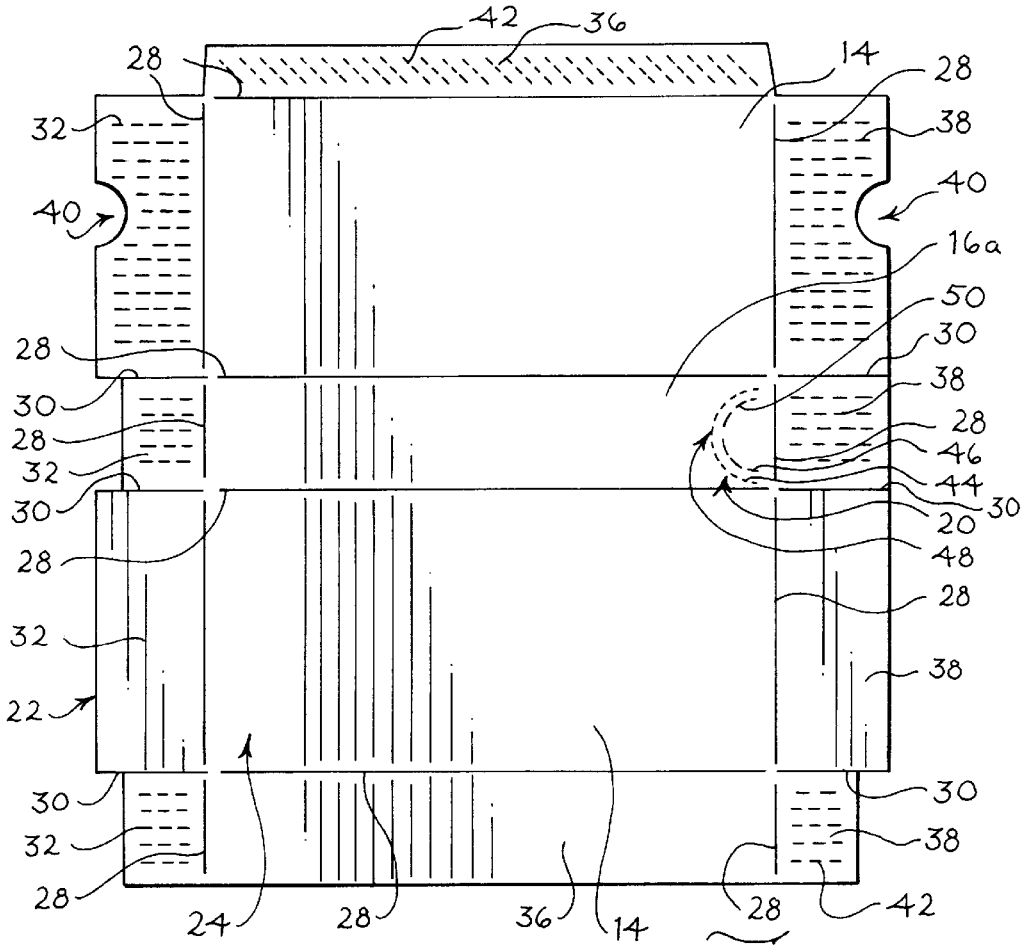
FIG. 2 is top plan view of the blank used to form the container shown in FIG. 1, showing the outer surfaces of the container with optional glue lines for adhesively fixing together the flaps used to form the container.
Figure 5:
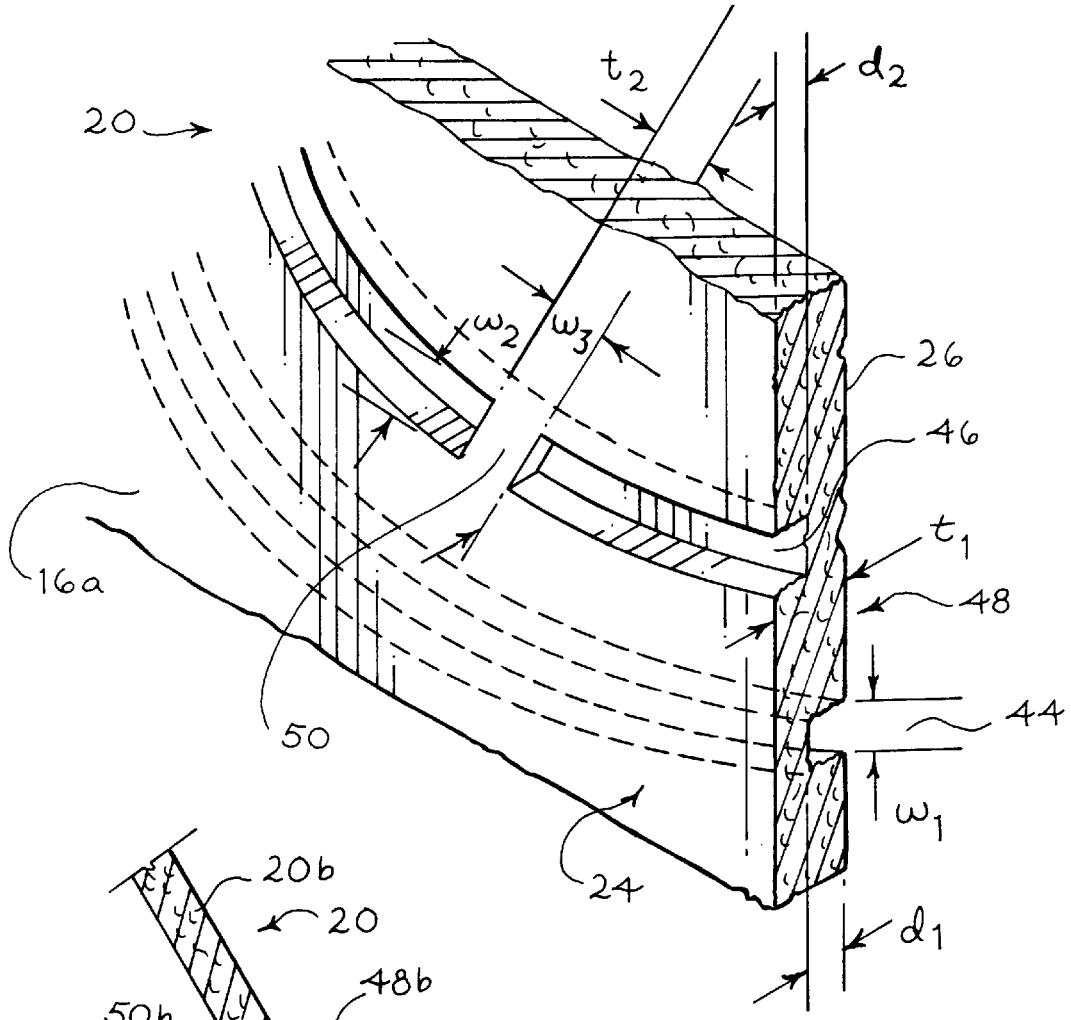
FIG. 5 is a cross-sectional perspective view of the opening tab of FIG. 1 long the lines 5–5 of FIG. 4.

In this preferred embodiment, the container 10 is formed from a unitary blank 22, as shown in FIGS. 2 and 3, cut from roll stock material such as paperboard; coated paperboard; composite materials of paper, polymers, fillers and other materials; polymeric materials; or other suitable packaging materials. In one preferred embodiment, the container 10 is made from a single piece of paperboard having a thickness "$t_1$" (as shown in FIG. 5) generally in the range of 0.016 to 0.018 inches (0.041 to 0.046 cm). Other paperboard thickness ranges also may be used in the invention depending on the end use of the container, the expected container strength requirements, and the cost and manufacturing requirements for large volume production of the container. The roll stock material may be pre-printed and may be overcoated with a protective coating, depending on the expected use for the container. The blank 22 typically is cut from the roll stock using cutting dies such as those often used for that purpose, or other suitable cutting equipment.

As shown in FIGS. 2 and 3, the blank 22 used to form the preferred embodiment of the container 10 is provided with an outer surface 24 and an inner surface 26. When formed into the container 10, portions of the outer surface 24 provide an exposed surface that may carry printed information, pre-printed packaging display designs or other such optional information. The inner surface 26 may be provided with sanitary, moisture, grease or other barriers suitable for the container's 10 expected use. In this preferred embodiment, the formed one piece blank prevents product leakage and protects the contents of the container without the use of inner liners or overwraps.

As shown in FIGS. 2 and 3, the blank 22 is scored to form fold lines 28 to define and assist the folding and formation of the top panel 12, large side panels 14, small side panels 16*a* and 16*b* and bottom panel 18. The blank 22 is further provided with separation cuts 30 to define and free the top panel flaps 32 so that they may be folded and adhesively fixed together to form the top panel 12. The separation cuts 30 also define and free bottom panel flaps 38 so that they may be folded and adhesively fixed to form the bottom panel 18. The small side panel flaps 36 similarly are folded and adhesively fixed to form the side panel 16*b*. The other side panel 16*a* and the large side panels 14 are formed by folding the blank 12 along the scored fold lines 28. The blank 22 typically is passed through a set of scoring and cutting dies to form the score fold lines 28 and separation cuts 30.

The size, length and configuration of the scored fold lines 28 and separation cuts 30, and the adhesives used to form the container 10 may be selected and modified as necessary for the particular size, shape, expected use and configuration of the container 10. The blank 22 further may be provided with optional cut outs 40 to assist in the automated handling of the blank and formation of the container 10. In addition, partial perforations 42 that penetrate any surface coatings may be provided in the outer surface 24 of the blank 22 on the flaps 32, 36 and 38 to assist in their adhesion together to form the top panel 12, side panel 16*b* and bottom panel 18.

In this preferred embodiment, a first cut line 44 extends partially through the inner surface 26 of the blank 22, as shown in FIGS. 3 and 5, and as shown in phantom lines in FIGS. 2 and 4. The first cut line 44 preferably extends to a depth "$d_1$" approximately 40% to 50% of the thickness $t_1$ of the blank and has a width "$w_1$" of approximately 0.002 to 0.007 inches (0.005 to 0.018 cm). The depth $d_1$ and width $w_1$ of the cut line may be modified as necessary depending on the thickness and type of materials used and the expected stress load during shipping, handling and use of the container 10.

A second cut line 46 is formed in the outer surface 24 of the blank 22 as shown in FIGS. 1, 2, 4 and 5, and in phantom lines in FIG. 3. The depth "$d_2$" of the second cut line 46 preferably is approximately 40% to 50% of the thickness $t_1$ of the blank and the width "$w_2$" of the second cut line is approximately 0.002 to 0.007 inches (0.005 to 0.018 cm). The second cut line 46 is offset a predetermined distance "$O_d$" from the first cut line 44 to form a frangible area 48 between the first cut line 44 and second cut line 46. In one preferred embodiment, the offset distance "$O_d$" between the first cut line 44 and second cut line 46 is approximately 0.25 inches (0.635 cm), and this offset $O_d$ is approximately uniform along the first cut line 44 and second cut line 46. The frangible area 48 allows the easy open tab 20 to separate from the container 10 side wall 16*a* when pressure is exerted on the easy open tab 20 as further discussed below.

The depth $d_2$ and width $w_2$ of the second cut line 46 and the offset distance $O_d$ may be modified depending on the expected loads and stresses on the container, the expected shipping and handling environment, the needs of large volume production, and the end use of the container 10. In addition, the offset distance $O_d$ need not be uniform between the first cut line and 44 and second cut line 46, as long as a sufficiently small distance between the cut lines 44 and 46 is maintained to permit the opening tab 20 to separate from the container panels under the expected end use conditions.

To inhibit undesired opening of the container during transport, storage and handling, the second cut line 46 further is provided with restraining portions 50 preferably formed integrally with the outer surface of the blank 22 by periodically interrupting the second cut line 46, leaving the restraining portions 50 uncut. These restraining elements 50 effectively bridge the second cut line 46 to reinforce the frangible area 48 and to inhibit separation of the opening tab 20 from the container panel. In the preferred embodiment, at least one restraining portion 50 is provided at the portion of the frangible area 48 that is believed to be subject to the highest strains during typical shipping, handling and storage of the container, which is located near the bottom periphery of the easy open tab 20 shown in FIGS. 1–6. Preferably, four additional restraining portions 50 are approximately evenly spaced along further increase the resistance of separation of all or part of the opening tab 20 from the container panel.

As shown in FIG. 5, the restraining portions 50 in the preferred embodiment of the container 10 have a width "$w_3$" of approximately 0.0937 to 0.125 inches (0.238 to 0.032 cm) wide and have a thickness "$t_2$" approximately the same as the thickness $t_1$ of the container blank 22. The restraining portions 50 preferably are sized and shaped to resist partial separation of the opening tab 20 from the container side wall 16*a* during shipping and handling, as well as during display and use of the container 10 by a retailer or consumer. The restraining portions 50 further inhibit the delamination or separation of portions of the opening tab 20 and the adjacent outer surfaces 24 and inner surfaces 26 of the side panel 16*a* due to columnar loading, bursting forces, compressive damage, and other forces which might penetrate or prematurely open the container 10.

The number, width and thickness of the restraining portions 50 are selected in view of the type of packaging materials used, the size and shape of the easy open tab 20, the expected stresses and forces that may be exerted on the container 10, and the minimum amount of pressure which is to be permitted to cause the separation of the easy open tab 20 from the container 10 panels. The restraining portions 50 should effectively strengthen the frangible area 48 to increase the force needed to separate all or part of the opening tab 20 from the side panel of the container 10 when compared to an opening tab formed by similar first and second cuts without the restraining portions 50.

In another embodiment (not shown), the first cut line may be provided with reinforcing elements in conjunction with those provided for the second cut line, or as an alternative to providing restraining portions 50 for the second cut line 46. The restraining portions 50 may be provided by other structures such as strips of separable paper or other tearable materials, laminated overlays, or other such elements capable of reinforcing the frangible area 48 while permitting the easy open tab 20 to separate from the container under a predetermined localized pressure.

Figure 7:
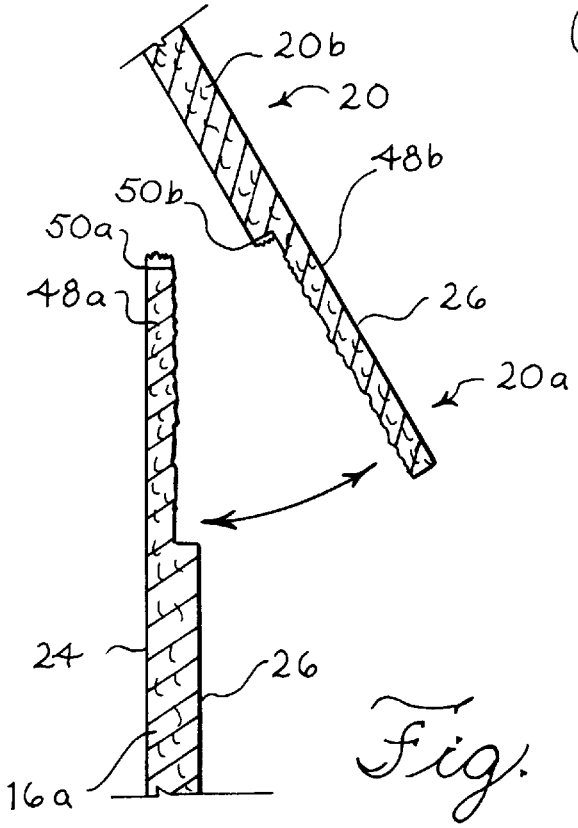
FIG. 7 is a cross-sectional view of the opening tab of FIG. 1 shown in an opened position.

To use the easy open tab 20 in the preferred embodiment shown in FIGS. 1–7, the user employs a finger, thumb or other similar implement to press on the opening tab 20, typically proximate the second cut line 46. When sufficient pressure is exerted, the paper fibers and/or other materials in the frangible area 48 and reinforcing elements 50 begin to separate from each other, permitting the easy open tab 20 to detach from the small side panel 16*a* and to move towards the interior of the container 10. As illustrated in FIGS. 6 and 7, portions 48*a* and 50*a* of the frangible area and the reinforcing elements, respectively, remain on the small side panel 16*a*, and other portions 48B and 50*b* of the frangible area and restraining portions, respectively, remain with the easy open tab 20. The portion 48*b* of the frangible area remaining on the easy open tab 20 provides a peripheral portion 20*a* of the easy open tab 20 with an outer border defined by the first cut line 44.

In the preferred embodiment shown in FIG. 6, the upper portion 20*b* of the easy open tab 20 forms a hinge along a fold line 28*a* defining the border of the small side panel 16*a* and a top panel flap 38. Accordingly, the easy open tab 20 remains attached to the side panel 16*a* and may be pushed into the container to form a dispensing aperture 52. The lower border of the dispensing aperture 52 is defined by the second cut line 46. In the preferred embodiment, the size of the dispensing aperture 52 may be varied depending on the size and nature of the product within the container 10 and the desired dispensing rate.

To enlarge the dispensing aperture, the user may insert a finger, thumb or other implement into the initial aperture 52 and pull upwardly and towards the top panel 12. With the application of sufficient force, the container material forming the top panel 12 will tear, extending the dispensing aperture 52 into the top panel 12. In this preferred embodiment, the paperboard at the fold lines 28 forming the peripheral edges of the top panel flaps 32 are sufficiently weakened by the scoring and folding of the blank 22 to present lines of weakness and the top panel 12 will tear along those fold lines 28.

In the embodiment shown in the FIGS. 1–7, the first cut line 44 and second cut line 46 have a semi-circular configuration which also provides a semi-circular easy open tab. The configuration of the cut lines 44 and 46 and the resulting shape of the easy open tab 20 are subject to the design requirements of the container. One may utilize "V" shaped, "U" shaped, square, rectangular or other shapes for the cut lines 44 and 46, and consequently for the easy open tab 20, in other embodiments. Similarly, the second cut line 46 is depicted in the FIGS. 1–7 as offset towards the top panel with respect to the first cut line 44. In some applications, it may be desirable to reverse the respective offset of the first 44 and second 46 cut lines with regards to the top panel.

Furthermore, the invention provides considerable flexibility in the choice of materials, the size and the configuration of the elements of the easy open tab 20, the cut lines 44 and 46, the frangible area 48, the restraining portions 50 and the dispensing opening 52. This allows one to predetermine and adjust the pressure and force necessary to open the container 10 to take into account the intended use for the container 10, the size, shape and materials used to make the container 10, the desired location for the easy open tab 20, the loads and stresses that will be imposed on the container 10, and the needs of high volume commercial production.

FIGS. 8 and 9 illustrate a frequently used prior art opening tab design 60. In that design, multiple rows of partial perforations 62 are used to define an opening tab 64 on one side panel of a paperboard container 66. These perforations are made only on one face of the panel, which forms the exterior of the example shown in FIGS. 8 and 9. The partial perforations extend to a depth less than the thickness of the paperboard, typically 40% to 60% of the thickness of the paperboard. The tab 64 is operated by finger or thumb pressure towards the interior of the container which causes the tab 64 to separate from the panel 66 and to form an opening 68 in the side panel. The opening may be enlarged by continued pulling on the tab 64 towards the top panel. Such tabs are often very difficult to operate, and, times, may not separate before the container side panel 66 or other parts of the container become damaged or crushed.

In the preferred design approach, the dimensions of the cut lines 44 and 46, the dimensions of the frangible area 48, and the number, materials and dimensions of restraining portions 50 are selected so that the resistance of the tab 20 to separation from a container panel is no greater than that required to maintain the tab 20 in a closed, commercially acceptable condition (ie., without unacceptably high occurrences of delamination, premature failure, cracks, disruptions, etc.) under the loads and stress typically encountered in shipping and handling procedures, retail warehousing, retail stocking procedures and consumer transportation and storage of the container. These parameters are further selected to require less pressure to separate the easy open tab 20 from a container side panel than required for prior art opening systems such as those shown in FIGS. 8 and 9.

Accordingly, the invention reduces the likelihood of inadvertent leakage, spoilage or damage to the products within the container and potential for infestation of the container, while providing a definite improvement in ease of opening when compared to prior art opening systems including those shown in FIGS. 8 and 9. A further example of one preferred embodiment of the invention is discussed below.

EXAMPLE

One embodiment of the container of the invention was made using a blank for a food box cut to dimensions similar to those shown in FIGS. 1–7. Three sets of boxes were formed from conventional food packaging grade paperboard, in this instance, a clay coated, recycled linerboard with a thickness of 0.017 inches (0.043 cm). In one set of boxes (Set A) first and second cut lines were formed in a side panel of each box in a generally semi-circular shape and configuration as shown in FIGS. 1–7, but without any restraining portions. The cut lines extended to about 50% of the thickness of the paperboard, and were offset about 0.25 inches (0.635 cm), with the radius of the second cut line smaller than first cut line as illustrated in FIGS. 1–7. The second set of boxes (Set B) were essentially identical to Set A, except that the cut lines extended to about 40% of the thickness of the paperboard.

The third set of boxes (Set C) also were essentially identical to the Set A, except that the second cut line was provided with five restraining portions with the relative proportions and configuration generally illustrated in FIGS. 1–7. The restraining portions were formed by periodically interrupting the second cut line and their thickness was approximately the same as the paperboard. The width of each restraining portion length measured along the second cut line was about 0.039 inches (0.10 cm).

The force required to separate the easy open tab from the side panel of each of the above box designs was measured using a standard compression cell in an Instron test instrument typically used for compression testing and stress-strain studies. The Instron instrument was supplied with a test block that provided lateral support for the test specimen and provided an opening below the easy open tab. With this test block, the force was measured that was needed to depress the opening tab until the tab separated from the surrounding side panel and moved into the opening in the test block. The results were as follows, arranged in order of the force required to separate the opening tab:

| Design | Avg. Opening Force in pounds (Kg) |
|---|---|
| Set A | 7.25 (3.29) |
| Set C | 8.05 (3.65) |
| Set B | 9.81 (4.45) |

The test results from Sets A and C confirmed that the restraining portions significantly increased (by at least about 11%) the opening tab's resistance to separation from the surrounding side panel for a given cut line depth. Thus, the easy opening feature of the invention may be tailored to specific marketing and commercial production needs using the reinforcing elements of the invention.

In addition, informal, subjective comparisons were made between the force required to open prior art designs such as that shown in FIGS. 8 and 9 and the easy opening features of the invention. These comparisons were made using boxes from Set C above and boxes having essentially the same design and construction with the prior art opening system shown in FIGS. 8 and 9. These tests confirmed that less force was required to separate the opening tab of the invention from the box side panel than required for the prior art design.

The design Sets A, B and C also were subject to simulated distribution stress and impact force testing using the following ASTM standard practices: ASTM D 5276-94 "Standard Test Method for Drop Test Of Loaded Containers By Free Fall"; ASTM D 4728-87 "Standard Test Method for Random Vibration Testing Of Shipping Containers", and ASTM D 642-94 "Test Method for Determining Compressive Resistance of Shipping Containers, Components, and Unit Loads, and ASTM D 4169-94 "Standard Practice for Performance Testing Of Shipping Containers and Systems", at less than unit load, modified pursuant to the following sequence, all heights and weights are approximate:

1. Case bottom drop: Drop height of 15 inches (38.1 cm)
2. Truck Compression: Each case was individually compressed to the following load: (Shipping Height−1)×

(Case Weight)×3 (Safety Factor)=(7−1 layers)×(13 lbs (5.9 kg))×3 (Safety factor)=234 lbs (106.2 kg).

3. Stack Height Vibration: Product is stacked on vibration table 7 layers high. Where less than actual height was available, dummy cases were used which approximated the weight and style of the test item. The vibration standard used was Truck Spectrum ASTM-D-4169 Level II, for a 1 hour duration.
4. Case Bottom Drop: Drop Height of 15 inches (38.1 cm).
5. Warehouse Compression: Each case was individually compressed to the following load: (Warehouse Stack height−1)×(Case weight)×3 (Safety Factor)=(14−1)×(13 lbs (5.9 kg))×3 (Safety factor)=507 lbs (230 kg).
6. Case Bottom Drop: Drop height of 15 inches (38.1 cm).
7. Truck Compression—Each case is individually compressed to the following load: (Shipping height−1)×(Case Weight)×3 (Safety Factor)=(7−1 layers)×(13 lbs (5.9 kg))×3 (Safety factor)=234 lbs (106.2 kg).
8. Loose Load Vibration—A single layer of product was vibrated at 1.3 g/5 Hz for 40 minutes.
9. Case Drop Sequence: Each Case was individually drop tested as follows: Drop height of 15 inches (38.1 cm) except last bottom drop. The Case orientation was top, two adjacent bottom edges, two diagonally opposite bottom corners, bottom (30 inch (76.2 cm)).

A total of 12 cases (each containing 24 boxes) of each design Set A, B, and C were tested, as were 15 cases of a prior art box design control of essentially the same construction, but with the prior art opening feature shown in FIGS. 8–9. It is believed that this testing reflects typical shipping and handling procedures for such boxes. The testing stresses may be increased to represent unusual, extreme, or misuse conditions that may be encountered during shipping and handling of such containers which may be considered in final container designs.

In the above testing, none of the opening tabs tested boxes completely failed so that the contents were exposed to spoilage or infestation. However, the Set A and Set B designs exhibited delaminations of the outer surface of the cartons at the easy open tab that may well have caused a consumer to reject the box. In view of the limited number of boxes tested, those delaminations in even a relatively small number of the Set A and B designs were considered serious defects in view of the commercial production requirements for those box designs. When such boxes are produced on a commercial scale of millions to hundreds of millions of boxes annually, even a relatively small percentage of such defects can result in very large volumes of lost sales, rejected products and increased costs for product returns.

As discussed above, the invention provides an improved container and easy opening system that answers many of the deficiencies of prior art container designs. The invention further provides greater flexibility in packaging design at significant potential cost savings.

While the invention has been described by reference to certain specific descriptions and examples which illustrate preferred materials, configurations and conditions, it is understood that the invention is not limited thereto. Rather, all alternatives, modifications and equivalents with the scope and sphere of the invention so described are considered to be within the scope of the appended claims.

What is claimed is:

1. A container comprising a top wall and a bottom wall connected by one or more side walls; each of the walls having a preselected thickness, an outer surface and an inner surface, and fold lines defining the borders of the walls; at least one of the walls including an opening tab, at least one side of the tab formed by a border fold line of the wall;

the opening tab having a peripheral portion formed by a first cut line in the inner surface of the wall and a second cut line in the outer surface of the wall; the start and terminus of each of the first and second cut lines disposed substantially at the border fold line forming one side of the tab; the first and second cut lines extending to a depth less than the thickness of the wall;

the second cut line being spaced a predetermined distance from the first cut line sufficient to form a frangible area along the opening tab peripheral portion separable from the wall by the application of localized, inwardly-directed pressure without deforming the adjacent wall portions and foldable along the border fold line;

one or more restraining portions with a thickness $t_2$ and with a width $w_3$ extending along the opening tab peripheral portion with at least one of the restraining portions disposed at the portion of the tab subjected the greatest of said loads and stresses; the number of restraining portions, and the thickness $t_2$ and width $w_3$ of the restraining portions are effective to increase the resistance to delamination of the opening tab peripheral portion and the adjacent wall portions in response to direct and indirect stacking loads, impact loads, and other stresses imposed on the opening tab during transport storage and handling of the container relative to the resistance to delamination provided by a tab peripheral portion formed by continuous cut lines starting and terminating substantially at the border fold line of the opening tab with a depth 40% of the wall thickness and a greater resistance to opening when localized, inwardly-directed pressure is applied thereto; and the restraining portions further are effective to increase the inwardly-directed pressure required to permit separation of at least a portion of the opening tab from the wall by at least about 10%.

2. The container of claim 1 wherein the restraining portions are integral to the wall provided with the opening tab and span the second cut line at one or more preselected locations, and the first cut line is continuous.

3. The container of claim 2 wherein the wall provided with the opening tab is of a predetermined thickness $t_1$, the first cut line extends to a depth $d_1$ that is more than about 40% of $t_1$ and the second cut line extends to depth $d_2$ is more than about 40% of $t_1$.

4. The container of claim 3 wherein the depth of the first cut line $d_1$ and the depth of the second cut line $d_2$ are about 50% of the thickness $t_1$ of the wall provided with the opening tab.

5. The container of claim 3 wherein the second cut line is spaced a predetermined distance $O_d$ from the first cut line; and the depth of the first cut line $d_1$ and the second cut line $d_2$ and the distance $O_d$ between the first and second cut lines is effective to form the frangible area along the periphery of the opening tab.

6. The container of claim 3 wherein the thickness of the restraining portions $t_2$ is about the same as the thickness of the wall $t_1$.

7. The container of claim 1 wherein the opening tab includes an upper segment; and the second cut line and the upper segment of the opening tab define a dispensing aperture when at least a portion of the opening tab separates from the wall provided with the opening tab.

8. The container of claim 7 wherein the wall provided with the tab has at least one wall outer edge and the opening tab is disposed proximate to the wall outer edge.

9. The container of claim 8 wherein at least a portion of the upper segment of the opening tab is hingedly affixed to the wall provided with the opening tab.

10. The container of claim 9 wherein the dispensing aperture and the upper segment of the opening tab provide a finger grip effective to permit enlargement of the dispensing opening.

11. The container of claim 1 wherein the first sidewall has a preselected thickness $t_1$; the first cut line has a preselected depth $d_1$ and a preselected width $w_1$; the second cut line has a preselected depth $d_2$ and a preselected width $w_2$; and the restraining portions have preselected thickness $t_2$ and a preselected width $w_3$; the thickness $t_2$ and width $w_3$ of the restraining portions relative to the thickness $t_1$, the depths $d_1$ and $d_2$, and the widths $w_1$ and $w_2$ are effective to inhibit the separation of at least a portion of the opening tab from the first sidewall when pressure is applied to the opening tab until a predetermined pressure is exerted on the opening tab.

12. The container of claim 11 wherein the restraining portions are effective to reinforce the frangible area such that greater pressure on the opening tab is required to separate of the tab peripheral edge from the first sidewall than the pressure required to separate the tab peripheral edge from the first sidewall in the container without the restraining portions.

13. The container of claim 12 wherein the side walls and the top wall have one or more peripheral borders; and one of the first side wall border is coterminous with a top wall border; and the opening tab is disposed proximate the coterminous border.

14. The container of claim 13 wherein the opening tab includes an upper section disposed opposite the peripheral edge portion of the opening tab; the upper section, having an upper edge defined by the side wall border coterminous with a top wall border; the upper edge hingedly affixed to the first side wall.

* * * * *